US007210943B1

(12) United States Patent
Chang et al.

(10) Patent No.: US 7,210,943 B1
(45) Date of Patent: May 1, 2007

(54) CONNECTOR

(75) Inventors: Yi-Yu Chang, Chung Ho (TW); Chun-Hsu Chen, Chung Ho (TW)

(73) Assignee: Jess-Link Products Co., Ltd., Taipei County (TW)

( * ) Notice: Subject to any disclaimer, the term of this patent is extended or adjusted under 35 U.S.C. 154(b) by 41 days.

(21) Appl. No.: 11/274,127

(22) Filed: Nov. 16, 2005

(51) Int. Cl.
*H01R 12/00* (2006.01)

(52) U.S. Cl. ..... 439/76.1

(58) Field of Classification Search ..... 439/76.1, 439/610
See application file for complete search history.

(56) References Cited

U.S. PATENT DOCUMENTS 6,139,357 A * 10/2000 Shih ..... 439/493
6,165,006 A * 12/2000 Yeh et al. ..... 439/490
6,203,333 B1 * 3/2001 Medina et al. ..... 439/76.1
6,210,229 B1 * 4/2001 Lai ..... 439/610
6,290,530 B1 * 9/2001 Chang ..... 439/378
6,319,040 B1 * 11/2001 Chang ..... 439/352
6,328,588 B1 * 12/2001 Tsai et al. ..... 439/352
6,336,827 B1 * 1/2002 Akama et al. ..... 439/610
6,431,887 B1 * 8/2002 Yeomans et al. ..... 439/108
6,565,366 B1 * 5/2003 Wu ..... 439/76.1
6,582,252 B1 * 6/2003 Lin ..... 439/610
6,585,528 B1 * 7/2003 Lin et al. ..... 439/76.1
6,589,066 B1 * 7/2003 Wu ..... 439/352
6,592,391 B1 * 7/2003 Wu ..... 439/352
6,619,987 B2 * 9/2003 Kumamoto et al. ..... 439/610
6,641,425 B1 * 11/2003 Wu ..... 439/352
6,648,665 B1 * 11/2003 Wu ..... 439/352
6,659,790 B1 * 12/2003 Wu ..... 439/352
6,663,415 B1 * 12/2003 Wu ..... 439/460
6,663,428 B1 * 12/2003 Wu ..... 439/608
6,685,501 B1 * 2/2004 Wu et al. ..... 439/497
6,685,511 B2 * 2/2004 Akama et al. ..... 439/610
6,702,603 B2 * 3/2004 Wu ..... 439/352
6,705,894 B1 * 3/2004 Comerci et al. ..... 439/607
6,716,057 B1 * 4/2004 Wu ..... 439/497
6,722,912 B2 * 4/2004 Wu ..... 439/352
6,736,667 B1 * 5/2004 Wu ..... 439/484
6,739,904 B2 * 5/2004 Wu ..... 439/497
6,776,658 B2 * 8/2004 Tang ..... 439/607
6,866,533 B2 * 3/2005 Wu ..... 439/352
6,869,308 B2 * 3/2005 Wu ..... 439/497
6,887,091 B1 * 5/2005 Wu ..... 439/352
6,890,189 B1 * 5/2005 Wu ..... 439/76.1
6,893,270 B2 * 5/2005 Sercu ..... 439/76.1
6,984,151 B2 * 1/2006 Wu ..... 439/610

(Continued)

*Primary Examiner*—Ross Gushi
(74) *Attorney, Agent, or Firm*—Rosenberg, Klein & Lee

(57) ABSTRACT

A connector has a cable module, a sleeve, and a case body. The cable module has a printed circuit board, a cable, and an insulating member. The printed circuit board has a plurality of electric pads disposed at a front thereof. The cable has an outer layer structure and a plurality of conducting wires. The insulating member is molded on the conducting wires and a front of the outer layer structure. The conducting wires are electrically connected to a rear of the printed circuit board. The sleeve is disposed around the outer layer structure of the cable and behind the insulating member. The case body forms a front opening in a front thereof. The case body forms a locking portion therein. The electric pads disposed at the front of the printed circuit board are located in the front opening, and the sleeve is positioned at the locking portion.

8 Claims, 5 Drawing Sheets

U.S. PATENT DOCUMENTS

| | | | | |
|---|---|---|---|---|
| 7,008,253 | B2 * | 3/2006 | Szczesny | 439/352 |
| 7,029,290 | B2 * | 4/2006 | Wu | 439/76.1 |
| 7,114,980 | B1 * | 10/2006 | Wu | 439/352 |
| 7,121,890 | B2 * | 10/2006 | Chang | 439/610 |
| 7,131,862 | B2 * | 11/2006 | Vermeersch | 439/497 |
| 7,134,914 | B1 * | 11/2006 | Wu | 439/610 |
| 7,147,501 | B1 * | 12/2006 | Wu | 439/352 |
| 7,147,502 | B1 * | 12/2006 | Wu | 439/352 |
| 7,160,135 | B1 * | 1/2007 | Wu | 439/352 |
| 7,163,408 | B1 * | 1/2007 | Chen et al. | 439/76.1 |
| 2002/0009906 | A1 * | 1/2002 | Akama et al. | 439/76.1 |
| 2003/0119343 | A1 * | 6/2003 | Lin et al. | 439/76.1 |
| 2004/0023545 | A1 * | 2/2004 | Wu | 439/352 |
| 2004/0023546 | A1 * | 2/2004 | Wu | 439/352 |
| 2004/0038564 | A1 * | 2/2004 | Yan | 439/76.1 |
| 2006/0030172 | A1 * | 2/2006 | Wu | 439/76.1 |
| 2006/0134946 | A1 * | 6/2006 | William Vermeersch | 439/76.1 |

* cited by examiner

CONNECTOR

BACKGROUND OF THE INVENTION

1. Field of the Invention

The present invention relates to a connector, and more particularly, to an electric connector.

2. Background of the Invention

Electric connectors include many types and are commonly used with various electronic products. For example, high-frequency connectors are indispensable components for communication products.

Referring to FIG. 1, a conventional connector provided by Fujitsu Component Limited includes a cable module 91 and a case body 93. The cable module 91 includes a printed circuit board 910, an inner insulating frame 911, a cable 912, a wire guiding rack 913, and a connection device 914. The inner insulating frame 911 retains a middle section of the printed circuit board 910. The cable 912 has a plurality of conducting wires 915. The conducting wires 915 are firstly penetrated through the wire guiding rack 913. Next, the conducting wires 915 are arranged via the wire guiding rack 913 to align with electric pads disposed at a rear of the printed circuit board 910. Next, the conducting wires 915 are electrically connected to the electric pads disposed at the rear of the printed circuit board 910. The connection device 914 is electrically connected to a front of the printed circuit board 910 for electrically contacting a mating connector.

As the printed circuit board 910, the inner insulating frame 911, the wire guiding rack 913, and the connection device 914 are received in the case body 93, the volume of the connector is therefore large.

Additionally, the cable 912 is not stably retained in the case body 93. Once the cable 912 is pulled, the printed circuit board 910 will become loose and its position will be altered.

SUMMARY OF THE INVENTION

The primary object of the invention is therefore to specify a connector with a reduced volume.

Another object of the invention is therefore to specify a connector with an improved and more stable cable.

According to the invention, the objects are achieved via a connector comprising a cable module, a sleeve, and a case body. The cable module includes a printed circuit board, a cable, and an insulating member. The printed circuit board has a plurality of electric pads disposed at a front thereof. The cable has an outer layer structure and a plurality of conducting wires. The conducting wires are disposed in the outer layer structure. The conducting wires define a front portion extending out of a front of the outer layer structure. The insulating member is molded on the conducting wires and the front of the outer layer structure. The conducting wires are electrically connected to a rear of the printed circuit board. The sleeve is disposed around the outer layer structure of the cable and behind the insulating member. The case body forms a front opening and a rear opening respectively in a front and a rear thereof. The case body forms a receiving space and a locking portion therein. The printed circuit board and the insulating member are received in the receiving space, the electric pads disposed at the front of the printed circuit board are located in the front opening, the sleeve is positioned at the locking portion, and the cable extends out of the rear opening.

As the printed circuit board has a plurality of electric pads disposed at a front thereof, the electric pads are located in the front opening of the case body, and the insulating member is molded on the conducting wires and the front of the outer layer structure of the cable, the volume of the connector of the present invention is reduced.

As the sleeve is disposed behind the insulating member and is positioned at the locking portion of the case body, the stability of the cable is improved.

To provide a further understanding of the invention, the following detailed description illustrates embodiments and examples of the invention. Examples of the more important features of the invention thus have been summarized rather broadly in order that the detailed description thereof that follows may be better understood, and in order that the contributions to the art may be appreciated. There are, of course, additional features of the invention which will be described hereinafter and which will form the subject of the claims appended hereto.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DETAILED DESCRIPTION OF THE EMBODIMENTS

Figure 1:
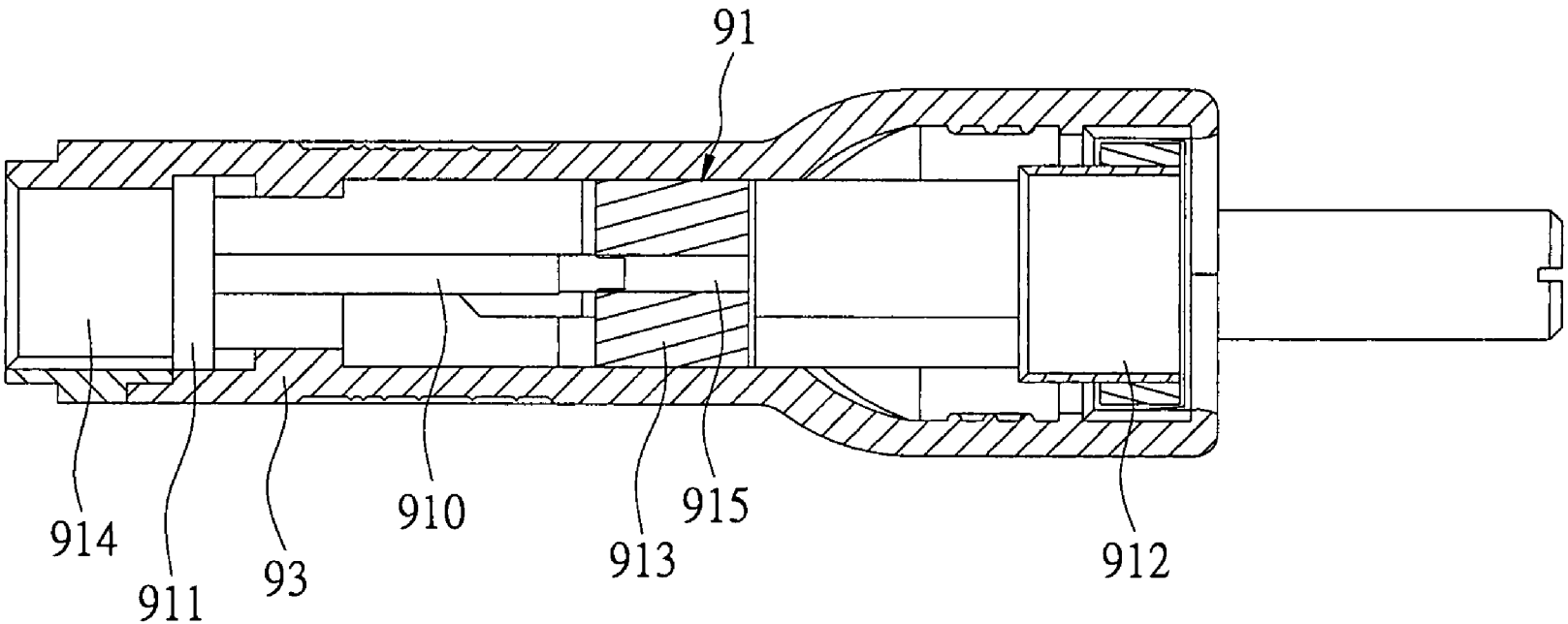
FIG 1 PRIOR ART
FIG. 1 is a cross-sectional view of a connector of the prior art.
Figure 2:
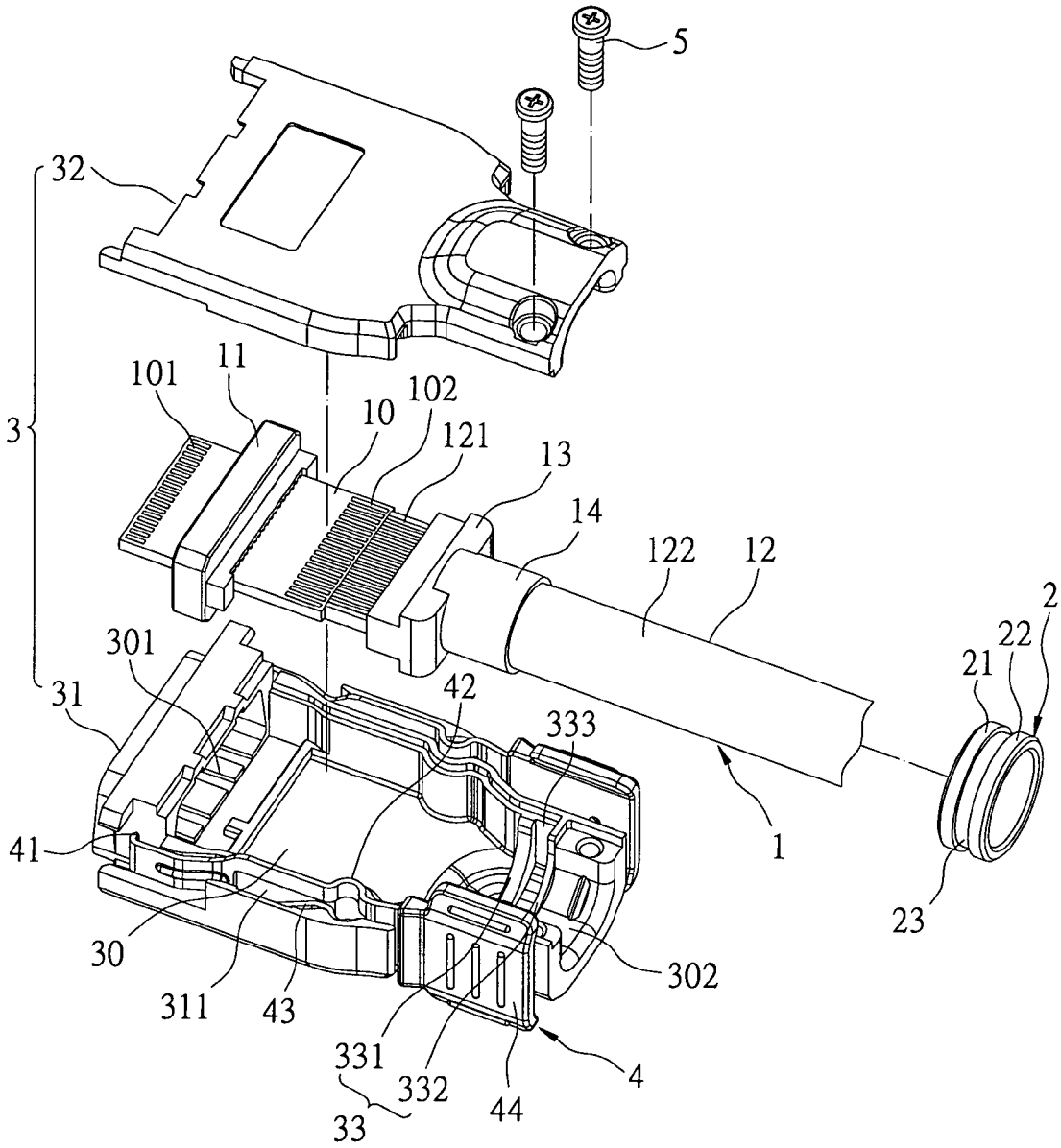
FIG. 2 is an exploded perspective view of a connector of the present invention.
Figure 3:
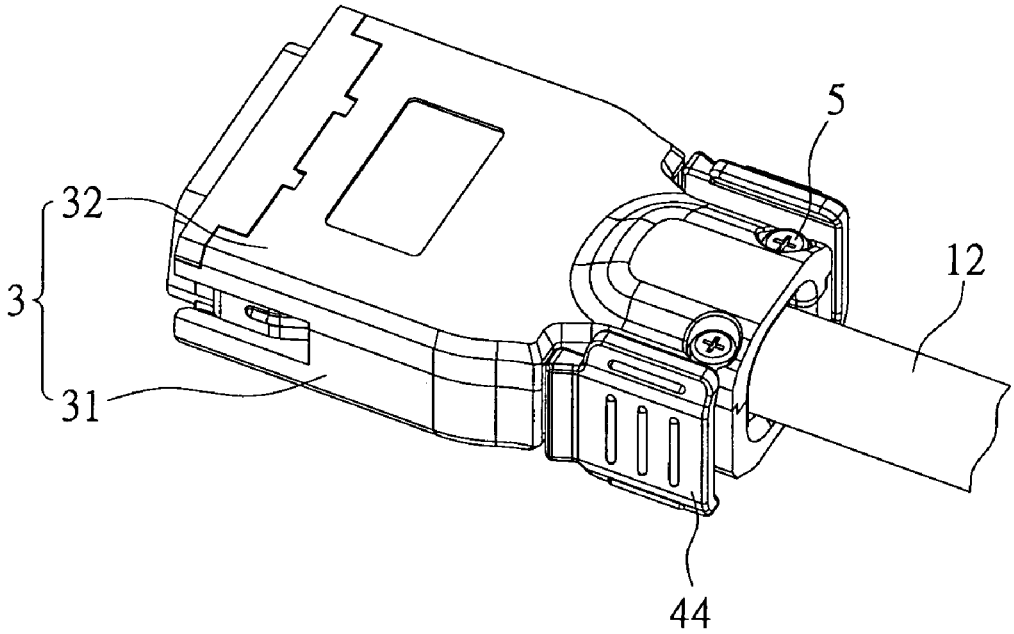
FIG. 3 is an assembled perspective view of a connector of the present invention.
Figure 4:
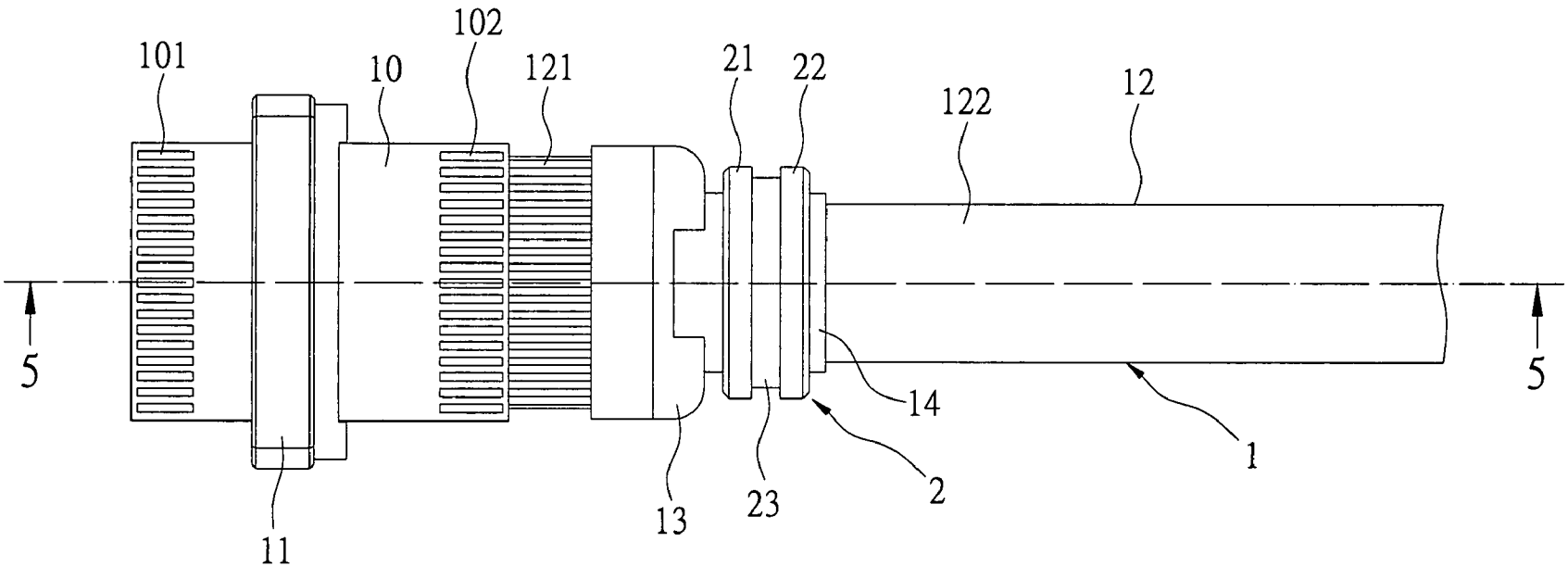
FIG. 4 is a schematic planar view of a cable module and a sleeve of a connector of the present invention.
Figure 5:
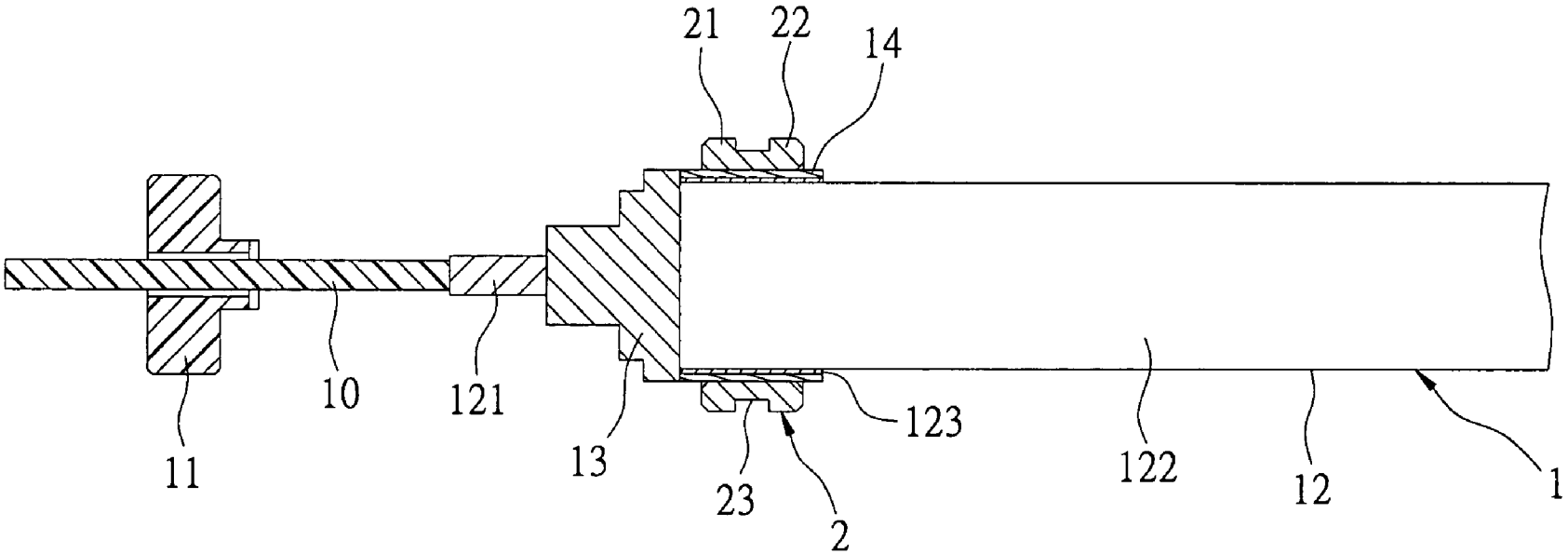
FIG. 5 is a cross-sectional view taken along line 5—5 of FIG. 4.

Referring to FIGS. 2–5, the present invention provides a connector comprising a cable module 1, a sleeve 2, a case body 3, and two latching members 4.

The cable module 1 includes a printed circuit board 10, an inner insulating frame 11, a cable 12, an insulating member 13, and a metal foil 14. The printed circuit board 10 has a plurality of electric pads 101 disposed at a front thereof for electrically contacting electric points of a mating connector. The printed circuit board 10 has a plurality of electric pads 102 disposed at a rear thereof for electrically connecting to the cable 12. The inner insulating frame 11 retains a middle section of the printed circuit board 10. The cable 12 has an outer layer structure and a plurality of conducting wires 121. The conducting wires 121 are disposed in the outer layer structure, and the conducting wires 121 define a front portion extending out of a front of the outer layer structure. The outer layer structure includes an outer insulating layer 122 and a braiding layer 123. The braiding layer 123 is located between the outer insulating layer 122 and the conducting wires 121, and the braiding layer 123 has a front extending out of a front of the outer insulating layer 122 and being bent reversely to cover the front of the outer insulating layer 122. The metal foil 14 is disposed around the front of the outer layer structure of the cable 12. In other words, the metal foil 14 is disposed around the front of the braiding layer 123.

The conducting wires 121 are firstly arranged via a fixture (not shown) to align with the electric pads 102 disposed at the rear of the printed circuit board 10. Next, the insulating member 13 is molded on the conducting wires 121 and the front of the outer layer structure and covers a front section of the metal foil 14. Next, the conducting wires 121 are electrically connected to the electric pads 102 disposed at the rear of the printed circuit board 10 accurately.

The sleeve 2 is made of metal material. The sleeve 2 is disposed around the outer layer structure of the cable 12 and behind the insulating member 13. In addition, an inner annular surface of the sleeve 2 contacts a rear section of the metal foil 14 to have an electromagnetic shielding effect. In this embodiment, the sleeve 2 has a front flange 21 and a rear flange 22 disposed on an outer annular surface thereof. The front flange 21 and the rear flange 22 forms an annular concavity 23 there between.

The case body 3 includes a first outer casing 31 and a second outer casing 32 connected with each other. The case body 3 forms a front opening 301 and a rear opening 302 respectively in a front and a rear thereof. The case body 3 forms a receiving space 30 and a locking portion 33 therein. In this embodiment, the locking portion 33 is disposed at the first outer casing 31 and has a front block 331 and a rear block 332. The front block 331 and the rear block 332 forms a recess 333 there between. In addition, the first outer casing 31 has two grooves 311 respectively disposed on two lateral sides thereof.

Each of the latching members 4 has a hook tab 41 disposed at a front section thereof. Each of the latching members 4 has a supporting arm 42 and a resilient arm 43 disposed at a middle section thereof. Each of the latching members 4 has a pressing portion 44 disposed at a rear section thereof.

In assembly, the printed circuit board 10, the inner insulating frame 11, and the insulating member 13 are received in the receiving space 30 of the case body 3, and the electric pads 101 disposed at the front of the printed circuit board 10 are located in the front opening 301 of the case body 3, thereby the volume of the connector of the present invention is reduced. The rear flange 22 of the sleeve 2 matches the recess 333 of the case body 3, and the front block 331 of the case body 3 matches the annular concavity 23 of the sleeve 2, thereby the sleeve 2 is reliably positioned at the locking portion 33 and the cable 12 extends out of the rear opening 302 of the case body 3. The supporting arm 42 and the resilient arm 43 of each of the latching members 4 are received in a corresponding one of the grooves 311. The hook tab 41 of each of the latching members 4 is located on a front of a corresponding one of the lateral sides of the first outer casing 31. The pressing portion 44 of each of the latching members 4 is located on a rear of a corresponding one of the lateral sides of the first outer casing 31. The connector of the present invention further comprises a fastener 5 (such as a screw). The fastener 5 penetrates through the second outer casing 32 and fastens the first outer casing 31, thereby the cable module 1, the sleeve 2, the latching members 4, and the case body 3 are stably combined.

In use, the pressing portion 44 of each of the latching members 4 are pressed inwardly, so that the hook tab 41 of each of the latching members 4 are opened outwardly to latch with a mating connector. Once the cable 12 is pulled, the sleeve 2 holds the insulating member 13 to prevent the cable 12 from moving, so that the printed circuit board 10 of the cable module 1 will not become loose and its position cannot be altered.

As indicated above, the connector of the present invention has the following advantages:

1. The printed circuit board has a plurality of electric pads disposed at a front thereof, the electric pads are located in the front opening of the case body, and the insulating member is molded on the conducting wires and the front of the outer layer structure of the cable, thereby the volume of the connector of the present invention is reduced.

2. The sleeve is disposed behind the insulating member and is positioned at the locking portion of the case body, thereby the stability of the cable is improved.

It should be apparent to those skilled in the art that the above description is only illustrative of specific embodiments and examples of the invention. The invention should therefore cover various modifications and variations made to the herein-described structure and operations of the invention, provided they fall within the scope of the invention as defined in the following appended claims.

What is claimed is:

1. A connector comprising:

a cable module including a printed circuit board, a cable, and an insulating member, the printed circuit board having a plurality of electric pads disposed at a front thereof, the cable having an outer layer structure and a plurality of conducting wires, the conducting wires being disposed in the outer layer structure, the conducting wires defining a front portion extending out of a front of the outer layer structure, the insulating member being molded on the conducting wires and the front of the outer layer structure, and the conducting wires being electrically connected to a rear of the printed circuit board;

a sleeve disposed around the outer layer structure of the cable and behind the insulating member; and a case body forming a front opening and a rear opening respectively in a front and a rear thereof, the case body forming a receiving space and a locking portion therein, the printed circuit board and the insulating member being received in the receiving space, the electric pads disposed at the front of the printed circuit board being located in the front opening, the sleeve being positioned at the locking portion, and the cable extending out of the rear opening.

2. The connector as claimed in claim 1, wherein the printed circuit board of the cable module has a plurality of electric pads disposed at the rear thereof, and the conducting wires are electrically connected to the electric pads disposed at the rear of the printed circuit board.

3. The connector as claimed in claim 1, wherein the cable module includes an inner insulating frame, the inner insulating frame retains a middle section of the printed circuit board, and the inner insulating frame is received in the receiving space of the case body.

4. The connector as claimed in claim 1, wherein the sleeve has a front flange and a rear flange disposed on an outer annular surface thereof, the front flange and the rear flange forms an annular concavity there between, the locking portion of the case body has a front block and a rear block, the front block and the rear block forms a recess there between, the rear flange of the sleeve matches the recess of the case body, and the front block of the case body matches the annular concavity of the sleeve.

5. The connector as claimed in claim 1, wherein the cable module includes a metal foil, the metal foil is disposed around the front of the outer layer structure of the cable, the insulating member covers a front section of the metal foil, the sleeve is made of metal material, and an inner annular surface of the sleeve contacts a rear section of the metal foil.

6. The connector as claimed in claim 5, wherein the outer layer structure of the cable includes an outer insulating layer and a braiding layer, the braiding layer is located between the outer insulating layer and the conducting wires, the braiding layer has a front extending out of a front of the outer insulating layer and being bent reversely to cover the front of the outer insulating layer, and the metal foil is disposed around the front of the braiding layer.

7. The connector as claimed in claim 1, comprising two latching members, wherein each of the latching members has a supporting arm and a resilient arm disposed at a middle section thereof, the case body includes a first outer casing and a second outer casing connected with each other, the first outer casing has two grooves respectively disposed on two lateral sides thereof, and the supporting arm and the resilient arm of each of the latching members are received in a corresponding one of the grooves.

8. The connector as claimed in claim 7, comprising a fastener, wherein the fastener penetrates through the second outer casing and fastens the first outer casing.

* * * * *